United States Patent [19]

Derderian

[11] 3,948,151

[45] Apr. 6, 1976

[54] CASE SEALER FOR SEALING THE BOTTOM FLAPS OF ERECTED AND SQUARED CASES

[76] Inventor: Edward J. Derderian, 4514 N. Wilson Ave., Fresno, Calif. 93704

[22] Filed: Oct. 29, 1974

[21] Appl. No.: 518,503

[52] U.S. Cl. ..... 93/36.3; 53/387

[51] Int. Cl.[2] ..... B31B 1/62; B31B 3/74

[58] Field of Search ..... 93/36.3, 36 SQ, 36 MM, 93/46, 50, 36 R; 53/387

[56] References Cited

UNITED STATES PATENTS

| | | | |
|---|---|---|---|
| 1,442,727 | 1/1923 | MacGowan | 53/387 |
| 3,312,154 | 4/1967 | Pierce | 93/36.3 X |
| 3,473,447 | 10/1969 | Ullman et al. | 93/36.3 |
| 3,482,489 | 12/1969 | Neal et al. | 93/36.3 |
| 3,608,440 | 9/1971 | Reichert et al. | 93/36.3 |
| 3,792,563 | 2/1974 | Mercer et al. | 53/387 X |

*Primary Examiner*—James F. Coan

*Attorney, Agent, or Firm*—Huebner & Worrel

[57] ABSTRACT

A sealer characterized by a case erecting station at which pre-scored case blanks are erected into open-top cases having a squared configuration, a case sealing station disposed in spaced relation with said case erecting station, an intermittently operable conveyor for serially advancing erected cases from the case erecting station to the case sealing station, pivotal brake shoes for maintaining each of said cases in a squared configuration at the case sealing station, and a pressure applicator including a ram-actuated pressure plate for impacting against the flaps of each of said cases while the cases are maintained in a squared configuration by said shoes.

2 Claims, 7 Drawing Figures

CASE SEALER FOR SEALING THE BOTTOM FLAPS OF ERECTED AND SQUARED CASES

BACKGROUND OF THE INVENTION

The invention generally relates to case sealers and more particularly to an improved case sealer particularly adapted rapidly and effectively to fold and seal the bottom flaps of erected cases.

The prior art, of course, is replete with case sealers utilized for sealing the articulated flaps of erected cases.

Frequently, case sealers currently employed utilize sealing mechanisms for plowing the bottom flaps of erected and filled cases into an overlapping relationship with a quantity of glue confined between selected surfaces of the flaps. In such instances, it is not uncommon for the bottom major flaps of a case to be plowed upwardly into an overlapping relationship with the minor flaps of the case while the case is supported by the weight of the contents previously deposited therein.

In instances where it has been attempted to seal the bottom major flaps of an erected case, prior to the filling of the case, a great deal of difficulty has been encountered in achieving a "squared" case of sufficient integrity to maintain a squared configuration during subsequent handling operations. Such consequences often are experienced because the adhesive simply does not penetrate the flaps sufficiently to achieve an adequate bonding of the flaps.

It is, therefore, the general purpose of the instant invention to provide an improved case sealer through the use of which squared cases having enhanced integrity resulting from adequately sealed bottom flaps are provided for subsequent filling.

OBJECTS AND SUMMARY OF THE INVENTION

It is an object of the instant invention to provide a case sealer which overcomes the aforementioned difficulties and disadvantages.

It is another object to provide an improved case sealer particularly suited for sealing folded bottom flaps of erected and squared cases preparatory to subsequently performed filling operations.

It is another object to provide in an improved case sealer means adapted to assure that erected cases are properly squared as they are introduced into a case sealing station at which pressure is applied to selected articulated flaps.

It is another object to provide an improved case sealer particularly suited for sealing the articulated bottom flaps of erected, open-top cases while the cases are maintained in a substantially squared configuration.

It is another object to provide an improved case sealer having an erecting station at which cases formed of fibrous material are erected into a squared configuration, a sealing station at which overlapping, articulated bottom flaps of the erected cases are struck an impacting blow by a pressure plate and thereafter supported in engagement with the flaps for a period of a predetermined duration whereby the adhesive previously applied to the flaps is forced into the fibers of the material while the cases are positively supported in a squared configuration.

These and other objects and advantages are achieved through the use of a case sealer which is provided with a case erecting station at which pre-scored case blanks, formed of fibrous material, are erected into open-top cases having a squared configuration and vertically oriented wall panels from which are projected articulated bottom flaps, a case sealing station disposed in spaced relation with the case erecting station, an intermittently operable conveyor including a plurality of transversely oriented flight bars for engaging and serially advancing erected cases from the case erecting station to the case sealing station, supporting structure located at the case sealing station for supporting each of the cases in a squared configuration, and a vertically displaceable pressure plate mounted at the distal end of an axially extensible ram for engaging overlapping articulated flaps with a force and for a period of time adequate for forcing previously applied adhesive into the fibrous material of the flaps, as will hereinafter become more readily apparent by reference to the following description and claims in light of the accompanying drawings.

DESCRIPTION OF THE PREFERRED EMBODIMENT

Figures 1, 2, 7:
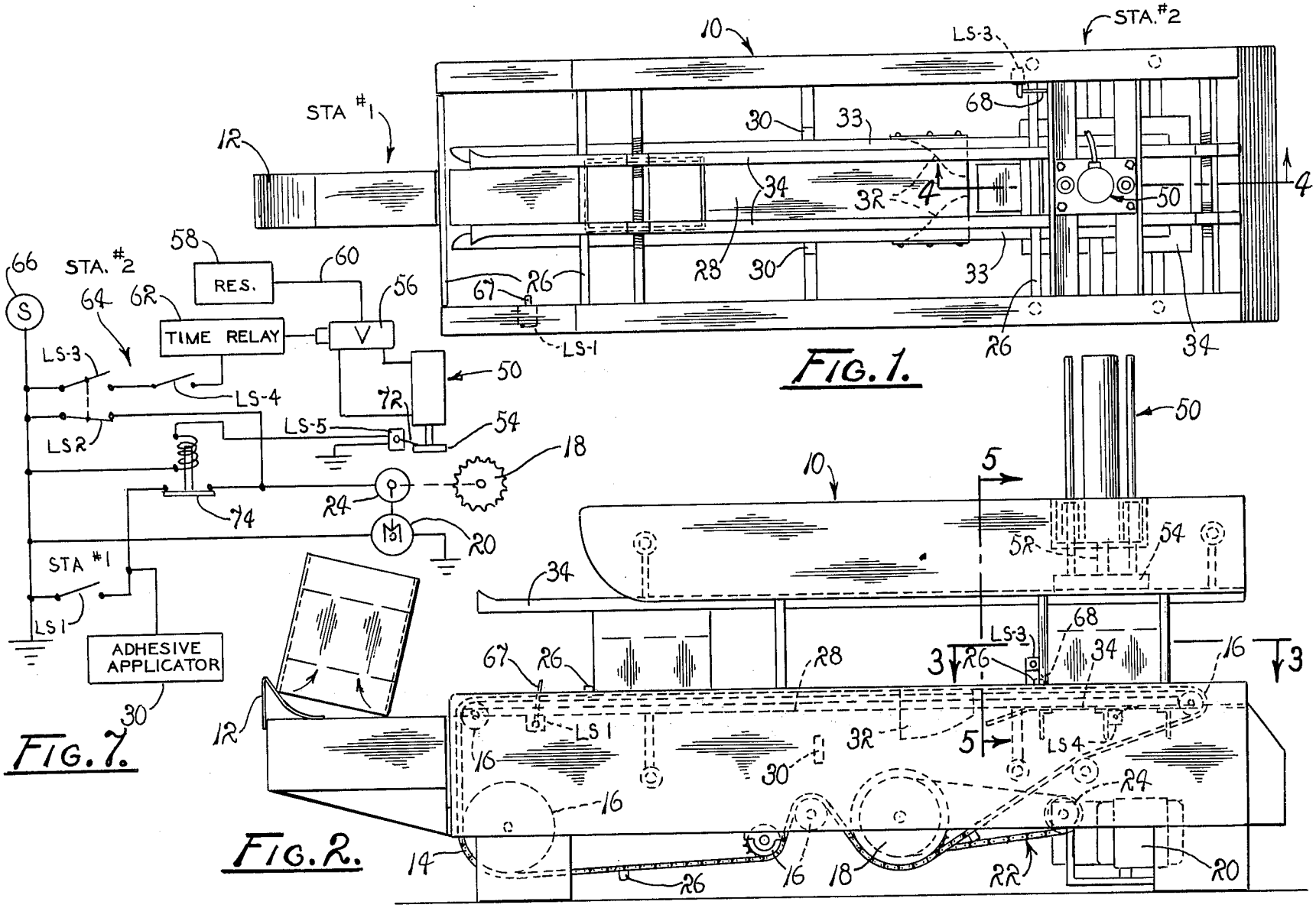
FIG. 1 is a top plan view of a case sealer which embodies the principles of the instant invention.
FIG. 2 is a side elevation of the case sealer.
FIG. 7 is a diagram of a control circuit for controlling the sequence of operation of the case sealing machine.
Figure 3:
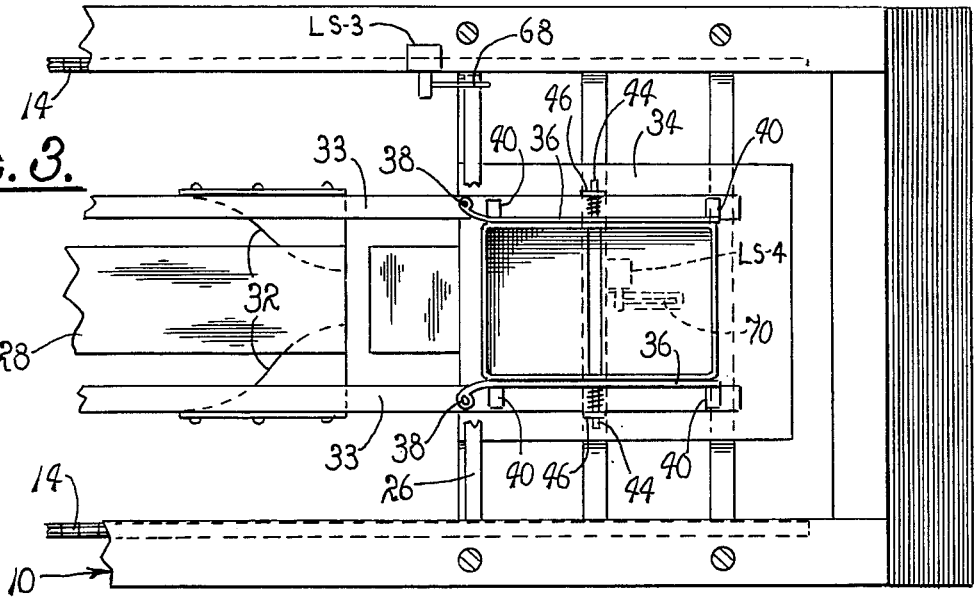
FIG. 3 is a fragmented sectional view taken generally along line 3—3 of FIG. 2.

Referring now to the drawings with more particularity, wherein like reference characters designate like or corresponding parts throughout the several views, there is shown in FIG. 1 a case sealing machine, generally designated 10, which includes a suitable frame, not designated.

The machine 10 includes a case erecting station, designated STA number 1, located at one end of the machine and a case sealing station, designated STA number 2, located at the opposite end of the machine.

At the case erecting station there is a horn 12 of an arcuate configuration provided for engaging the minor flaps of an erected and squared case blank so that a folding of the minor flaps into a folded horizontal disposition can be manually effected. While the horn 12 serves to accommodate a manual erection of the case blanks, it should readily be apparent that minor flaps can be folded into a horizontal case closing disposition through the use of any suitable mechanisms.

Extended between the case erecting station and the case sealing station there is an intermittently operable conveyor, not designated. This conveyor includes a pair of laterally spaced conveyor chains 14 trained about a plurality of suitably oriented idler sprockets 16, and driven by a pair of coaxially aligned driving sprockets 18, only one of which is shown in FIG. 2.

The driving sprockets 18 are connected with a suitable motor 20 through a power train, generally designated 22. This power train includes a chain-driving sprocket, not designated, connected with the motor 20 through an air-actuated clutch 24. Since air clutches are of known design, a detailed description of the clutch 24 is omitted in the interest of brevity. However, it is to be understood that the clutch 24 is controlled by an electrically energizable valve, not shown, and responds to a delivery of air, delivered thereto under a preselected pressure, for effecting clutch-engagement.

Between the conveyor chains 14 there is extended a plurality of uniformly spaced, transversely oriented flight bars 26 which are advanced by the chains 14 for displacing erected cases along the surface of a horizontally oriented support plate 28. The plate 28, of course, serves to support the cases as they are serially transferred along a linear path, and in erected configurations, from the case erecting station to the case sealing station, through an engagement therewith of the flight bars 26, as the flight bars are advanced through intermittent rotation of the sprockets 18.

As a practical matter, beneath the plate 28, there is disposed an adhesive applicator including a pair of glue extrusion heads 30. Each of these heads is controlled by an electrically responsive valve, not shown, and serves to engage a surface of one of the major flaps of each case, as the case is advanced by the flight bars and apply thereto an extruded film of adhesive.

Immediately following the pair of extrusion heads 30, there is provided a pair of stationary plows 32 which serve to fold inwardly and upwardly the flaps to which adhesive has been applied by the extrusion heads 30. Since glue extrusion heads and flap-folding plows are well known a detailed description of the heads 30 and plows 32 is omitted.

In practice, a first pair of laterally spaced guide rails 33 is extended in parallelism along opposite sides of the aforementioned linear path for engaging the lowermost portions of the side walls of each case as it is advanced, while a second pair of guide rails 34 preferably is disposed in a plane vertically spaced from the plate 28. The guide rails 34 serve to engage the upper edge surface of the major flaps of each case as the case is advanced along the plate 28 between the aforementioned stations.

Located at the case sealing station, in coplanar alignment with the plate 28, there is provided a horizontally disposed platen 34 which serves to receive, in turn, each erected and squared case delivered to the case sealing station. Mounted in laterally spaced relation at the case sealing station, there is a pair of brake shoes, each being designated 36. The shoes 36 engage the opposite wall panels of each case as the case is delivered to the case sealing station and serve to arrest the motion thereof as well as to laterally support the case during subsequently performed case sealing operations.

Figure 6:
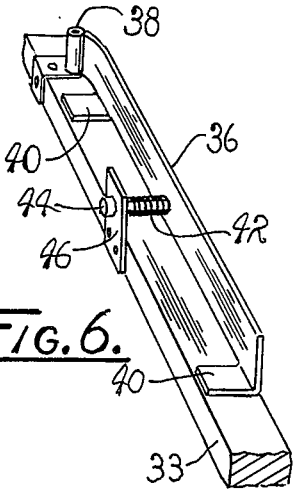
FIG. 6 is a perspective view of one of a pair of brake shoes provided for supporting cases in a squared configuration.

As best shown in FIG. 6, each of the brake shoes 36 is of an elongated configuration and is pivotally supported at one end thereof for oscillation about a vertically oriented pivot pin 38 while the opposite end of the shoe is vertically supported by a suitable wear plate 40 affixed thereto and seated on one of the guide rails 33.

Moreover, as best illustrated in FIG. 6, each of the brake shoes 36 is resiliently supported, in a horizontal direction, by a compression spring 42 mounted in concentricity with a suitable pin 44, also supported by one of the guide rails 33, through a bracket 46. It should, therefore, be readily apparent that the brake shoes 36 are spring-biased inwardly for engaging each of the cases as the cases are serially advanced onto the surface of the platen 34. Moreover, it should also be readily understood that while at the case sealing station each of the erected cases is supported at three sides through an engagement thereof with the brake shoes 36 and the flight bar 26 which served to advance the case onto the platen 34. Hence, it is to be understood that each erected case, in the event it has not been properly squared, is caused to assume a squared configuration as it is forced between the resiliently supported shoes 36 by an advancing flight bar 26. Of course, deformation of each case from a squared configuration during subsequently performed case sealing operations is precluded, due to the collective supporting effects of the shoes 36 and the flight 26 engaged therewith.

Mounted immediately above the platen 34, there is a ram generally designated 50, having an axially extensible shaft 52 supported for recilinear motion in a substantially vertical plane. To the lowermost or distal end of the shaft 52, there is affixed a pressure plate 54 configured to be received, in turn, by each erected case delivered to the case sealing station. It is important here to appreciate that the pressure plate 54 is driven downwardly by the shaft 52 into an impacting engagement with the overlapping bottom flaps of each case, with a force sufficient to drive adhesive confined between the flaps into the material thereof. This assures that the flaps of each case are rapidly and adequately sealed by the adhesive before the case is removed from the case sealing station.

It is known that adhesive employed in sealing cases has a propensity to set-up as the fiber of the flaps to which the adhesive is applied draws moisture from the adhesive. Therefore, by being forced inwardly into the material of the flaps by the impacting force of the pressure plate 54 the adhesive is caused to set-up quite rapidly, while the case is maintained in a squared configuration. Thus, each resulting case is characterized by a proper configuration and is of suitable integrity.

As a practical matter, the ram 50 is a double-acting, air-actuated ram controlled by a selector valve 56 connected with a reservoir 58 through a suitable conduit 60. The selector valve 56, in turn, is connected with a time relay 62, of a suitable design, which serves to control the duration of the period in which shaft 52 is extended for causing the pressure plate 54 to engage and support the folded flaps of each of the cases. The relay 62 is a suitable design having an operational cycle of a variable duration.

Referring now more particularly to FIG. 7, therein, for illustrative purposes, is shown a control circuit for controlling the sequence of operation for the case sealing machine 12. Of course, this circuit is varied as desired. As shown, the circuit, generally designated 64, is connected with an a.c. source of electrical energy 66 in a manner well understood by those familiar with the design and fabrication of case sealing machines. A normally-open limit switch $LS_1$ is provided at the case erecting station and is connected between the source of electrical energy 66 and a valve for the clutch 24, as well as between the source 66 and a valve for the adhesive applicator 30. The switch $LS_1$ includes a wiper arm 67 positioned to be engaged, for closing the switch, by an erected case as the case is advanced onto the plate 28. Upon closing of the switch $LS_1$, the clutch 24 responsively is engaged for causing the clutch 24 to couple the drive sprockets 18 to the motor 20, whereupon the flight bars 26 are advanced for delivering the erected case to the case sealing station. Simultaneously therewith the adhesive applicator 30 is activated.

Further, at the case sealing station there is provided a normally closed limit switch $LS_2$, also connected with the source 66, through which electrical energy is transmitted to the valve of the clutch 24 for effecting a coupling of the drive sprockets 18 with the motor 20. However, it is to be noted that also located at the case sealing station there is provided a third limit switch, designated $LS_3$, which is a normally open switch. The switch $LS_3$ is ganged with the switch $LS_2$ and is actuated simultaneously therewith by the presence of a flight bar passing under a wiper blade 68 provided therefor. As the flight bar passes under the wiper blade 68, the limit switch $LS_2$ is opened for interrupting electrical current to the clutch 24, while electrical current is delivered to a limit switch $LS_4$ connected in circuit series with the switch $LS_3$.

Figure 4:
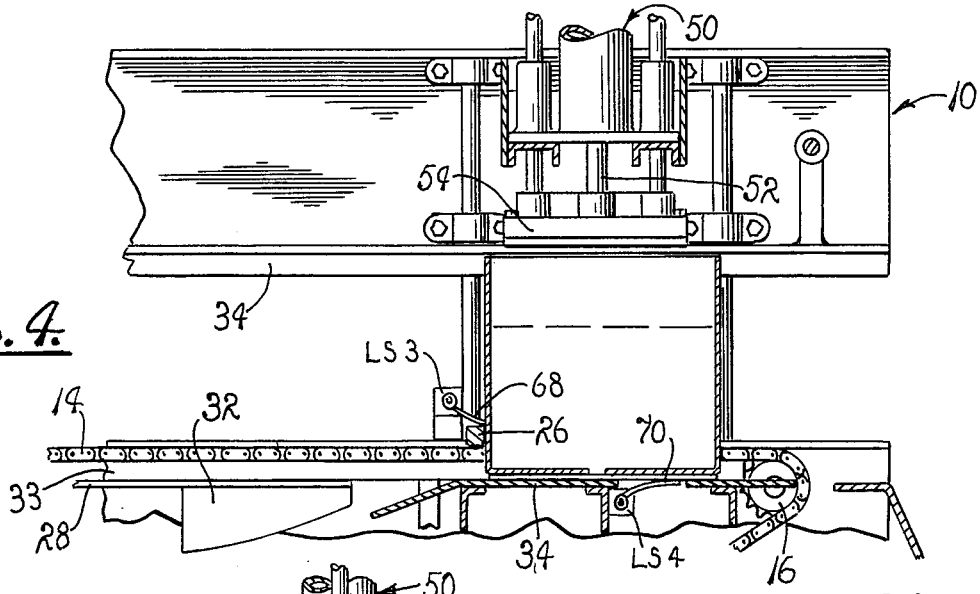
FIG. 4 is a sectional view taken generally along line 4—4 of FIG. 1.

As best shown in FIG. 4, the switch $LS_4$ is disposed beneath the platen 34 and includes a wiper arm 70 extended upwardly through the platen 34 to be engaged and depressed by a case as the case comes to rest on the platen 34. It should, therefore, be apparent that upon a closing of the switches $LS_3$ and $LS_4$ the time relay 62 becomes connected with the source 66 through the switches $LS_3$ and $LS_4$ for causing the ram 50 to advance the pressure plate 54 from a retracted position, to impact against the folded flaps of the case disposed at the case sealing station and subsequently return to its retracted position.

Figure 5:
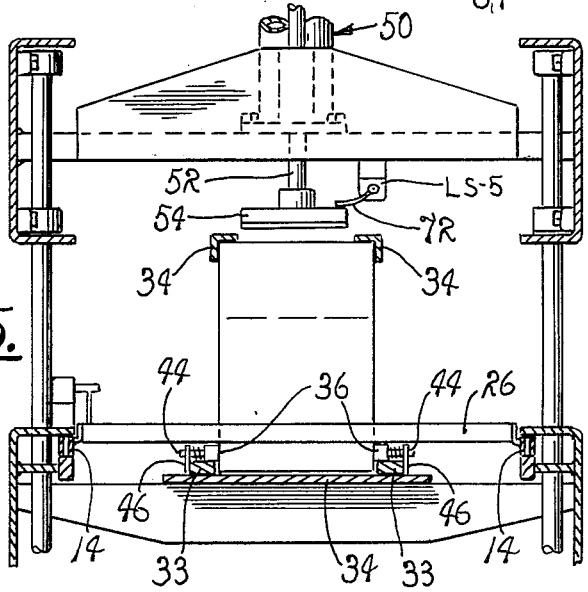
FIG. 5 is a sectional view taken generally along line 5—5 of FIG. 2.

Located immediately adjacent the pressure plate 54, to be engaged thereby when the ram 50 has completed a cycle of operation, there is a limit switch $LS_5$, FIG. 5, having a wiper arm 72 positioned to engage the pressure plate 54. Also connected to the limit switch $LS_5$, there is a solenoid actuated switch 74 which remains closed so long as the pressure plate 54 remains in contact with the wiper arm 72. However, as the ram 50 causes the pressure plate 54 to advance from its retracted position, the circuit to the switch 74 is interrupted so that should an erected case be positioned in engagement with the limit switch $LS_1$, the conveyor cannot be activated until the plate 54 is returned to its retracted position. Once the pressure plate 54 has been retracted, a closing of the normally open limit switch $LS_1$ will cause the conveyor to advance an erected case until such time as the switch $LS_2$ is opened in response to a flight bar passing beneath the wiper arm 68.

OPERATION

It is believed that in view of the foregoing description, the operation of the device will readily be understood and it will be briefly reviewed at this point.

With the machine assembled in the manner hereinbefore described, and adjusted through suitable adjusting mechanisms, not shown, the machine is prepared for operation.

An operator selects a case blank and manually erects the blank into a substantially squared configuration and seats it on the horn 12, whereupon the minor flaps are folded upwardly and inwardly. The operator manually advances the erected case onto the plate 28 to a position located between the conveyor chains 14 for engaging the wiper blade 67 of the limit switch $LS_1$. A circuit is thus completed to the clutch 24 simultaneously with the completion of the circuit to the adhesive applicator 30. In response thereto, the conveyor chains 14 are advanced for thus causing a flight bar 26 to engage and advance the erected case along the plate 28 to the case sealing station while simultaneously a sealed case is advanced from the case sealing station. As the flight bar engages the wiper blade 68 and the erected case engages the wiper blade 70, the switch $LS_2$ is opened while the switches $LS_3$ and $LS_4$ are closed for causing the ram 50 to complete a cycle of operation, wherein the pressure plate 54 is caused to impact against the folded flaps of the case for a period sufficient to force the fluid adhesive into the material of the flaps. As the plate 54 initially advances downwardly, the switch $LS_5$ is opened to assure that no further advancement of the conveyor chains will occur until the plate 54 has been retracted into engagement with the wiper blade 72. Thus, the cycle of operation for the machine is completed.

In view of the foregoing, it should readily be apparent that the machine of the instant invention provides a practical solution to the problem of erecting properly formed and sealed cases to be filled in subsequently performed operations.

Although the invention has been herein shown and described in what is conceived to be the most practical and preferred embodiment, it is recognized that departures may be made therefrom within the scope of the invention.

Having thus described my invention, what I claim as new and desire to secure by Letters Patent is:

1. In a case sealing machine, the improvement comprising:

A. a case erecting station at which prescored case blanks formed of fibrous material are erected into open-top cases, each of said cases being characterized by a substantially squared configuration and having articulated, vertically oriented leading, trailing, and opposite side wall panels including downwardly projected, articulated bottom flaps;

B. a case sealing station disposed in spaced relation with said erecting station;

C. an intermittently operable conveyor for serially advancing each of said cases from said case erecting station to said case sealing station including an elongated, horizontally oriented support plate, and a pair of intermittently operable conveyor chains extended in spaced parallelism between said case erecting station and said case sealing station along opposite sides of said support plate, and a plurality of flight bars, each of said flight bars being orthogonally related to the longitudinal axis of said support plate and connected at the opposite ends thereof to said pair of conveyor chains for serially engaging the trailing wall panel of each of said cases and imparting thereto advancing motion;

D. means disposed between said case erecting station and said case sealing station for applying a film of fluid adhesive to selected surfaces of selected bottom flaps of each of said cases;

E. means for positioning said bottom flaps of each of said cases in an overlapping relationship;

F. means for causing each of said cases to assume and maintain a substantially rectangular configuration at said case sealing station including a pair of elongated, resiliently supported brake shoes disposed between said conveyor chains and arranged in substantially spaced parallelism with the longitudinal axis of said support plate and adapted to frictionally engage the opposite side wall panels of each of said cases for restraining the case against motion imparted thereto by a flight bar; and G. means located at said case sealing station for forcing the film of adhesive applied to selected flaps into the fibrous material of the overlapping flaps of each case including an axially extensible ram having a pressure plate affixed thereto and supported thereby for displacement along a vertically oriented path into impacting engagement with the overlapping flaps of each case for a period of a predetermined duration.

2. The improvement of claim 1 further comprising circuit means for actuating said ram and said conveyor in a predetermined sequence of operation.

* * * * *